United States Patent [19]

Nevius

[11] Patent Number: 5,027,989

[45] Date of Patent: Jul. 2, 1991

[54] NEEDLEWORK STAND WITH STRETCH FRAME AND WORK TABLE

[76] Inventor: David L. Nevius, 1020 Miller La., Harrisburg, Pa. 17110

[21] Appl. No.: 534,287

[22] Filed: Jun. 7, 1990

[51] Int. Cl.[5] ..... A41H 5/00; A47F 5/05; A47F 5/04; A47F 5/00

[52] U.S. Cl. ..... 223/120; 38/102.1; 38/102.4; 38/102.6; 38/102.7; 108/6; 108/4; 248/124

[58] Field of Search ..... 223/120; 38/102.1, 102.3, 38/102.4, 102.6, 102.9, 102.91, 102.7; 211/134; 248/124, 122; 108/6, 94, 4

[56] References Cited

U.S. PATENT DOCUMENTS

| | | | |
|---|---|---|---|
| 361,248 | 4/1887 | Winton | 24/303 |
| 3,906,648 | 9/1975 | Bard | 38/102.2 |
| 3,955,722 | 5/1976 | Bard | 38/102.2 |
| 4,102,065 | 7/1978 | Selden | 38/102.1 |
| 4,175,343 | 11/1979 | Mathews | 38/102.1 |
| 4,189,856 | 2/1980 | Cookson | 38/102.4 |
| 4,229,890 | 9/1980 | Dropinski | 38/102.1 |
| 4,292,748 | 10/1981 | Miller | 38/102.1 |
| 4,378,646 | 4/1983 | Mazeika | 38/102 |
| 4,430,815 | 2/1984 | Wulc | 38/102.91 |
| 4,500,695 | 5/1986 | McGillivray | 38/102.2 |
| 4,841,415 | 6/1989 | Dobner | 362/90 |
| 4,893,423 | 1/1990 | Heinrich | 38/102.1 |

*Primary Examiner*—Werner H. Schroeder
*Assistant Examiner*—Bibhu Mohanty
*Attorney, Agent, or Firm*—Richard C. Litman

[57] ABSTRACT

A comprehensive needlework unit is provided that includes a work table, a detachable frame that holds the stitched fabric and a light source. The components are all mounted to separate pivotal arms that attach to an upright stand mounted to a base plate. The frame has two rollers with the fabric mounted between them. The rollers can be loosened or clamped down when it is desired to advance or lock in the fabric. The work table contains holders for scissors and scrap material as well as for pins and needles.

8 Claims, 2 Drawing Sheets

NEEDLEWORK STAND WITH STRETCH FRAME AND WORK TABLE

BACKGROUND OF THE INVENTION

1. Field of the Invention

The present invention relates to work holders that maintain a workpiece in a stationary position while a person performs a function that modifies the workpiece. More particularly, the present invention relates to a unit that holds a sheet of needlework fabric in a stretched manner for a person to stitch a pattern into the fabric. Prior to the present invention, needlework fabric was stretched over a stationary frame that was held in the lap by the person doing the stitching. With the present invention a roller mounted length of fabric is provided so that the stitcher can continue needlework patterns beyond the borders of a normal fabric holder.

2. Description of the Prior Art

Numerous prior art devices are known which hold and secure fabric for needlework. Issued U.S. Patents which are known to the applicant are listed and described below.

U.S. Pat. No. 3,906,648 issued to Bard describes a frame for holding needlework fabric in a stretched manner in front of a seated needleworker. The fabric frame is attached to an adjustable stand that the needleworker sits upon. The drawback with this device is that the fabric is not adjustable on the frame. The frame is a conventional single sheet frame. New material cannot quickly be placed onto the frame.

U.S. Pat. No. 4,102,065 issued to Selden discloses an adjustable table for holding needlework. Though the area provided for the fabric is quite large, it is still limited compared to the continuous roll provided by the applicant's needlework fabric holder. This is still a conventional fabric frame in function as new fabric cannot be quickly rolled on to the needleworking surface.

U.S. Pat. No. 4,378,646 issued to Mazeika describes a workpiece holder that adjusts in a rotational manner. This device is similar in use to the holder shown in U.S. Pat. No. 3,906,648 to Bard in that the user seats upon a tongue and stabilizes the holder in front of him or her.

U.S. Pat. No. 361,248 issued to Winton discloses a magnetic holder for holding implements of various sorts, including needles and other sewing implements.

U.S. Pat. No. 4,841,415 issued to Dobner describes a means of illuminating work related to sewing and stitching. This device illuminates a very small area adjacent the needle of a sewing machine.

None of these prior art devices whether taken singly or in combination are felt to disclose the applicant's unique invention as disclosed in the present application.

SUMMARY OF THE INVENTION

Accordingly, it is an object of the present invention to provide a needlework unit that includes a fabric holder that uses a length of fabric mounted on a roller which can be fed out over the stitching area when necessary. This allows large continuous stitching patterns to be made continuously.

It is one object of the present invention to provide a needlework unit that has a fabric holder adjustably mounted to a central stand along with a worktable, an illumination source and a mounting base.

It is another object of the present invention to provide a needlework unit wherein the fabric frame, the work table and the illumination means are adjustable relative to one another. Each one is mounted upon its own pivoting arm allowing each component to rotate separately.

It is an additional object of the present invention to provide a needlework unit that has a mounting means for holding a model of the pattern to be stitched so that the stitcher can quickly and easily study the pattern from time to time.

It is a further object of the present invention to provide a needlework unit where the fabric frame having the roller mounted fabric disconnects from the rest of the apparatus and can be held separately when desired.

These and other objects of the present invention will become readily apparent upon further review of the following specification and drawings.

BRIEF DESCRIPTION OF THE DRAWINGS

Similar reference characters denote corresponding features consistently throughout the attached drawings.

A DETAILED DESCRIPTION OF THE PREFERRED EMBODIMENT

Figure 1:
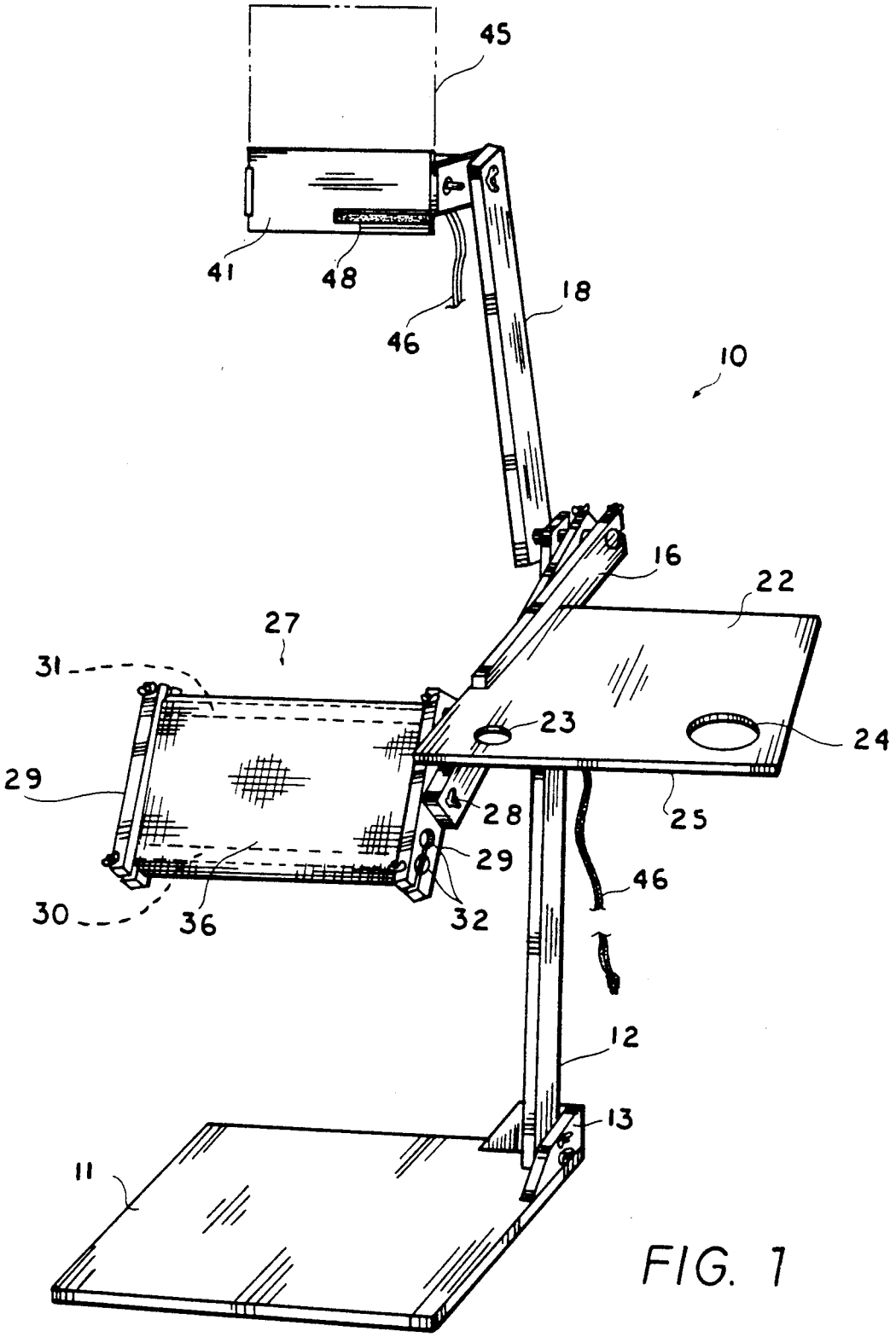
FIG. 1 is a perspective view of the present invention showing all components mounted to a single stand and base.

The present invention 10 is shown in FIG. 1 in its entirety. The needlework unit 10 stands upon as flat base plate 11. The base plate 11 should be of a large enough surface so as to provide plenty of stability to the whole needlework unit 10. Standing upright and mounted to the base plate 11 is the central stand 12 to which the major operative components of the needlework unit 10 are mounted. The stand 12 can be mounted to the base plate 11 in a number of ways. In FIG. 1 the stand 12 is shown With two side supports 13 that serve to stabilize the stand 12.

Figure 2:
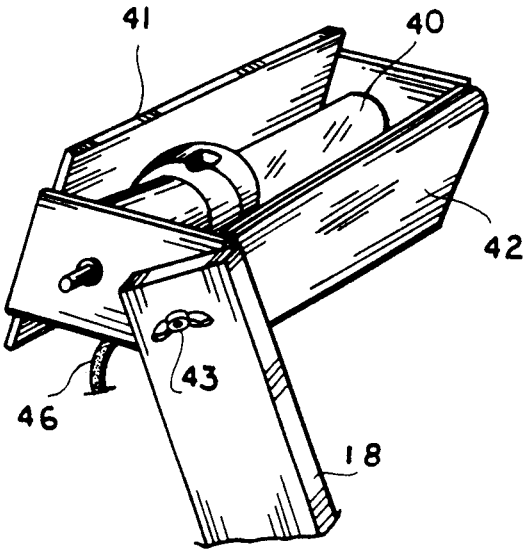
FIG. 2 is a perspective view of the rotating arm assembly for the fabric frame, the work table and the lighting.
Figure 3:
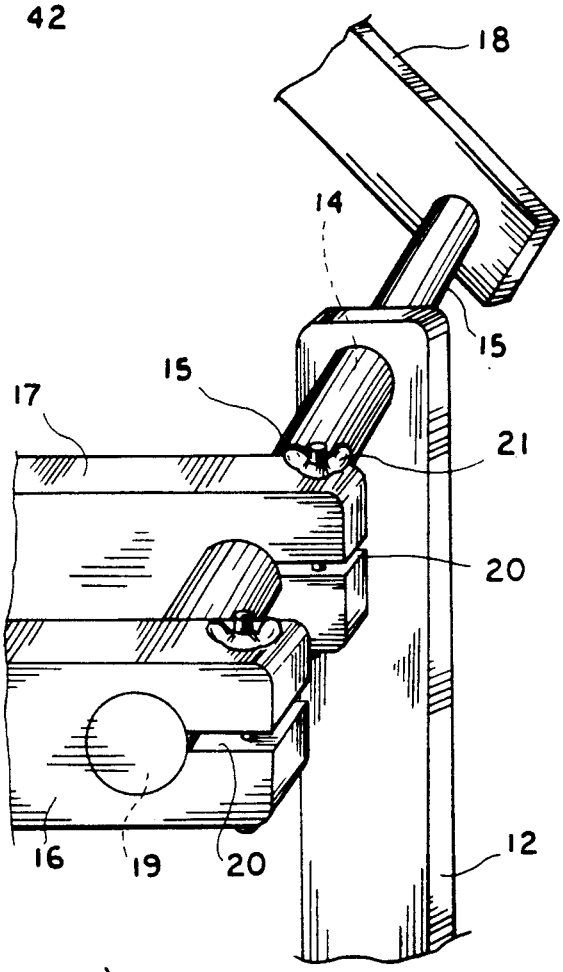
FIG. 3 is a perspective view showing a detailed illustration of how the fabric is mounted to the rollers.
Figure 4:
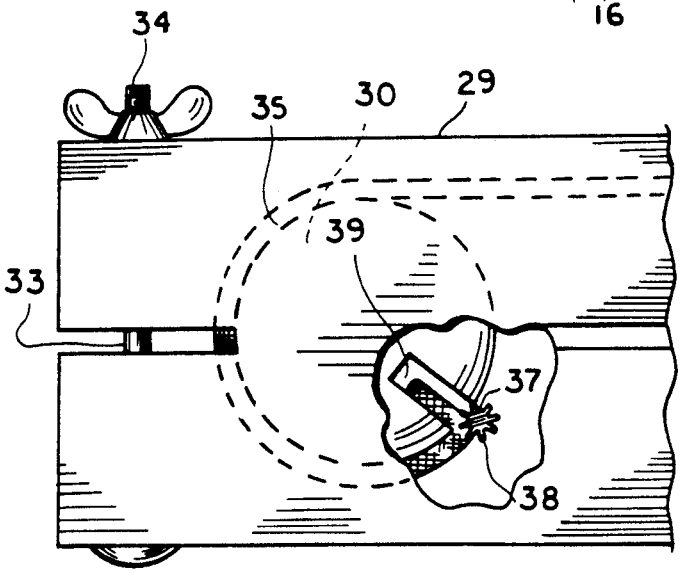
FIG. 4 is perspective view showing a the lighting means and the mounting for holding the pattern model.

The top end of the stand serves as the joint for the various components that make up the needlework unit. An aperture 14 disposed through the top of the stand 12 has a dowel 15 disposed through it. This dowel 15, made of wood, serves as the common pivot axis for the various components of the needlework unit 10. Three arms 16, 17 and 18 are mounted to the dowel 15. The dowel fits through an aperture 19 in each arm 16, 17, 18, allowing each arm to pivot about the dowel 15. This is best shown in FIG. 3. A slot 20 leads from the aperture 19 to the outer end of the arm 16, 17, 18. A screw bolt 21 allows the slot 20 to be opened or closed, thereby tightening or loosening the aperture 19 about the dowel 15. This allows the arms 16, 17, 18 to be locked in place or to be loosened and pivoted for adjustment.

Arm 16 holds the work table 22. The work table 22 is a one piece slab of wood that is bolted or glued to the arm 16. A pair of apertures 23, 24 are positioned at the lower end 25 of the work table 22 away from the dowel 15. One of apertures 23 is for placing a pair scissors in. The second aperture 24 on the work table 22 is for holding a scrap cup. The cup can be used to hold scrap material and/or pins and needles. For added storage, a magnetic strip 48 is mounted across the surface of the light shade 41. Needles and pins can be placed on the magnetic strip without worrying about their rolling off onto the floor.

Arm 17 supports the actual fabric frame 27. The distal end of the arm 17 detachably holds the fabric frame 27 by means of a bolt 28. Frame 27 can be removed so that it can be held separately when desired. The frame can therefore be taken on trips so that the needle work is available to be done. The frame 27 itself comprises two side members 29 that are connected in a parallel fashion by two spaced apart dowels 30, 31. The dowels 30, 31 are mounted in apertures 32. Slots 33 run from the apertures 32 to the end of the side members 29. A bolt 34 can be used to tighten or loosen the grip on the dowels as described above. The dowels 30, 31 are loosened so that the rolled up fabric 35 can be advanced when one section 36 has been completely stitched.

The fabric 35 is mounted to each dowel 30, 31 by means of an elongated tubular strip 37. The strip 37 has a series radially extending ribs 38 that give the strip 37 a tight fit within the slot 39 disposed along the length of the dowels 30, 31. The end of the fabric 35 is placed within the slot 39 and then the strip 37 is placed on top of the fabric 35 within the slot 39. When the dowels 30, 31 are loosened, the fabric 35 can be rolled around either dowel, in either direction, by hand. As stated before, the entire frame 27 can be removed for travel.

The third arm 18 holds the light frame 42 which functions as a mount for the light 40 and also as a pattern holder. The light frame 42 is pivotally mounted to the end of the arm 18 by means of a bolt 43. The light shade 41 mounted in front of the light 40, together with the pivoting of arm 18 and light frame 42, allows the light direction to be adjusted. The light frame 42 is deeply grooved so as to hold any flat board or piece of paper 45 that has the stitch pattern indicated upon it. Alternatively to the groove, clips or other attachment means could be used to hold the paper 45 relative to the light frame 42. An electrical cord 46 runs from the light 40 to an appropriate electrical outlet.

It is to be understood that the present invention is not limited to the sole embodiment described above, but encompasses any and all embodiments within the scope of the following claims.

I claim:

1. A needlework unit that provides a complete workstation for a stitcher, including:

a lower base portion;

a stand attached to and extending upwardly from said base portion;

a frame means for holding needlework fabric pivotally attached to an upper portion of said stand;

a work table comprising a flat planar surface pivotably attached to an upper portion of said stand;

an illumination means pivotally attached to an upper portion of said stand; whereby each of said frame means, work table and illumination means can adjust in position to accommodate a person using the needlework unit.

2. The needlework unit according to claim 1, wherein:

said fabric frame, work table and illumination means are each separately attached to an arm, each said arm is pivotally connected to a dowel, said dowel is in turn disposed through an upper end of said stand and is stationary in relation to said stand.

3. The needlework unit according to claim 1, including:

means to hold a needlework stitch pattern, said means being adjacent said illumination means.

4. The needlework unit according to claim 1, wherein:

said work table has means to hold tools placed thereon.

5. The needlework unit according to claim 2, wherein:

said fabric frame is detachably connected to said arm, thereby allowing said frame to be taken away and worked upon independently.

6. The needlework unit according to claim 1, wherein:

said fabric frame comprises two spaced apart parallel dowels that are rotatably mounted to two parallel side frame members, a length of needlework fabric is disposed between said dowels and can be advanced in either direction upon rotation of the dowels.

7. The needlework unit according to claim 6, wherein:

each end of said length of fabric is mounted within an axial slot on each said dowel, compression means holds said end within said slot.

8. The needlework unit according to claim 6, wherein:

said fabric frame is rotatably connected to said arm.

* * * * *